US009343050B2

(12) United States Patent
Sallee et al.

(10) Patent No.: US 9,343,050 B2
(45) Date of Patent: May 17, 2016

(54) CHANNELED SHAKER

(71) Applicant: DRUM WORKSHOP, INC., Oxnard, CA (US)

(72) Inventors: Jeff Sallee, Castaic, CA (US); Mark A Schnose, Fontana, CA (US); Andrzej J Krol, Wayne, NJ (US); Ray Enhoffer, Clifton, NJ (US); Richard Simons, Garfield, NJ (US)

(73) Assignee: DRUM WORKSHOP, INC., Oxnard, CA (US)

( * ) Notice: Subject to any disclaimer, the term of this patent is extended or adjusted under 35 U.S.C. 154(b) by 0 days.

(21) Appl. No.: 14/332,233

(22) Filed: Jul. 15, 2014

(65) Prior Publication Data

US 2015/0075354 A1 Mar. 19, 2015

Related U.S. Application Data

(63) Continuation of application No. 13/041,048, filed on Mar. 4, 2011, now Pat. No. 8,779,263.

(51) Int. Cl.
*G10D 13/06* (2006.01)

(52) U.S. Cl.
CPC ..... *G10D 13/06* (2013.01)

(58) Field of Classification Search
CPC ..... G10D 13/06
See application file for complete search history.

(56) References Cited

U.S. PATENT DOCUMENTS

| | | | | | |
|---|---|---|---|---|---|
| 478,611 | A | | 7/1892 | Knittel | 84/415 |
| 1,519,974 | A | * | 12/1924 | Ordway | 446/117 |
| 2,315,793 | A | * | 4/1943 | Jay | 84/476 |
| 2,318,460 | A | | 5/1943 | Brief | 446/419 |
| D139,512 | S | | 11/1944 | Allen | D21/406 |
| 2,440,205 | A | * | 4/1948 | McLain | 434/167 |
| 2,492,922 | A | * | 12/1949 | McLain | 434/403 |
| 2,499,483 | A | * | 3/1950 | Foy | 446/219 |
| 2,550,270 | A | * | 4/1951 | Jentzen | 446/85 |
| D165,407 | S | * | 12/1951 | Toombs et al. | D21/408 |
| 2,584,554 | A | | 2/1952 | Everett | 84/170 |
| 2,644,839 | A | | 7/1953 | Mathilda | 250/462.1 |
| 2,644,890 | A | * | 7/1953 | Hollihan | 250/462.1 |

(Continued)

FOREIGN PATENT DOCUMENTS

| | | |
|---|---|---|
| DE | 202005020022 | 2/2006 |
| DE | 202007000686 | 5/2007 |

(Continued)

OTHER PUBLICATIONS

Office Action from U.S. Appl. No. 14/109,915, dated Nov. 5, 2015.

(Continued)

*Primary Examiner* — Robert W Horn
(74) *Attorney, Agent, or Firm* — Koppel, Patrick, Heybl & Philpott

(57) ABSTRACT

A percussive shaker instrument with improved control in producing rhythmic sound and capable of producing different percussive sounds in a single shaker is disclosed. The shaker comprises one or more channels filled with a striker material. The channel isolates the striker material from the striker material in other channels and from any other part of the shaker. The striker material is freely movable within the channel such that it may collide with a striking surface when the shaker is moved.

9 Claims, 11 Drawing Sheets

(56) References Cited

U.S. PATENT DOCUMENTS

| | | | | | |
|---|---|---|---|---|---|
| 3,235,263 | A * | 2/1966 | Smith | 273/156 |
| 3,369,598 | A | 2/1968 | Heinz | 165/90 |
| 3,460,830 | A * | 8/1969 | Barlow et al. | 273/440 |
| 4,026,185 | A | 5/1977 | Migirian | 84/411 R |
| 4,165,671 | A * | 8/1979 | De Bose | 84/402 |
| 4,168,064 | A | 9/1979 | Petrovic | 473/466 |
| 4,179,973 | A * | 12/1979 | White | 84/402 |
| 4,278,248 | A * | 7/1981 | Kifferstein | 482/74 |
| 4,306,485 | A * | 12/1981 | Rudkin | 84/402 |
| D288,696 | S | 3/1987 | Hoshino | D17/22 |
| 4,790,714 | A * | 12/1988 | Schnapp | 446/486 |
| 4,833,964 | A | 5/1989 | Prouty | 84/411 R |
| 4,870,883 | A | 10/1989 | Gauger | 84/411 R |
| 4,901,617 | A * | 2/1990 | Malone et al. | 84/402 |
| 4,903,569 | A | 2/1990 | Kurosaki | 411/427 |
| 4,968,283 | A * | 11/1990 | Montgomery | 446/419 |
| 5,265,514 | A * | 11/1993 | Schertz | 84/422.4 |
| 5,280,742 | A | 1/1994 | Vergara | 84/411 R |
| 5,323,678 | A * | 6/1994 | Yould | 84/418 |
| 5,385,075 | A | 1/1995 | Carnes | 84/411 R |
| D359,063 | S * | 6/1995 | Falk | D17/99 |
| 5,483,859 | A * | 1/1996 | Singer | 84/322 |
| 5,659,143 | A * | 8/1997 | Isackson | 84/402 |
| 5,814,747 | A * | 9/1998 | Ramsell | 84/402 |
| 6,018,116 | A | 1/2000 | Simons | 248/345.1 |
| 6,146,236 | A | 11/2000 | Kay | 446/419 |
| 6,255,572 | B1 * | 7/2001 | Moghaddam et al. | 84/402 |
| 6,288,314 | B1 | 9/2001 | Cohen | 84/402 |
| 6,302,813 | B1 * | 10/2001 | Sturgeon et al. | 473/564 |
| 6,362,406 | B1 * | 3/2002 | Enhoffer et al. | 84/402 |
| 6,372,972 | B1 | 4/2002 | Meinl | 84/411 R |
| 6,512,169 | B1 * | 1/2003 | Santini | 84/402 |
| 6,555,736 | B1 * | 4/2003 | Delosreyes | 84/402 |
| 6,570,074 | B1 | 5/2003 | Rode | 84/413 |
| 6,620,991 | B1 * | 9/2003 | Honiball | 84/402 |
| 6,682,393 | B1 * | 1/2004 | Puett, III | 446/418 |
| 6,858,787 | B1 | 2/2005 | de Vries | 84/402 |
| 6,949,702 | B2 | 9/2005 | Ortega | 84/411 A |
| 6,953,883 | B1 | 10/2005 | Jacobson | 84/411 A |
| D511,354 | S * | 11/2005 | Cohen | D17/22 |
| 7,152,862 | B1 * | 12/2006 | Chiu | 273/109 |
| 7,169,994 | B1 | 1/2007 | Payerl | 84/402 |
| D571,851 | S | 6/2008 | Myers | D17/22 |
| 7,482,522 | B2 | 1/2009 | Wening | 84/411 R |
| 7,534,948 | B2 | 5/2009 | Rice | 84/404 |
| 7,601,901 | B2 | 10/2009 | Payerl | 84/411 R |
| 7,749,145 | B2 * | 7/2010 | Allen et al. | 482/148 |
| 7,910,816 | B2 * | 3/2011 | Glowacki | 84/410 |
| 8,008,560 | B2 | 8/2011 | Wiese | 84/411 R |
| D650,832 | S | 12/2011 | Wiese | D17/22 |
| 8,115,088 | B2 | 2/2012 | Herrera | 84/411 R |
| 8,263,848 | B2 | 9/2012 | Aspland | 84/411 R |
| 8,481,834 | B2 | 7/2013 | Eduardo | 84/411 R |
| 8,487,170 | B2 | 7/2013 | Klein | 84/411 R |
| 8,558,097 | B2 | 10/2013 | Krol et al. | 84/402 |
| 8,735,703 | B2 | 5/2014 | Dublin | 84/411 R |
| 8,735,704 | B2 | 5/2014 | Buchner | 84/411 R |
| 8,779,263 | B2 * | 7/2014 | Sallee et al. | 84/402 |
| 8,829,321 | B2 | 9/2014 | Klein | 84/411 R |
| 8,835,733 | B2 | 9/2014 | Boulet | 84/411 R |
| D735,265 | S | 7/2015 | Pires | D17/22 |
| 9,087,497 | B1 | 7/2015 | Krol et al. | 1/1 |
| 2004/0147201 | A1 | 7/2004 | Cohen | 446/419 |
| 2006/0060061 | A1 | 3/2006 | Henry | 84/413 |
| 2008/0141845 | A1 | 6/2008 | Kennedy | 84/413 |
| 2009/0064844 | A1 | 3/2009 | O'Connor | 84/411 R |
| 2009/0293703 | A1 | 12/2009 | Van der Meulen | 84/413 |
| 2011/0259173 | A1 * | 10/2011 | Bettinelli | 84/402 |
| 2012/0055315 | A1 * | 3/2012 | Sallee et al. | 84/402 |
| 2012/0297956 | A1 * | 11/2012 | Sallee et al. | 84/402 |
| 2013/0092010 | A1 * | 4/2013 | Krol et al. | 84/402 |
| 2014/0041508 | A1 | 2/2014 | Trask | 84/415 |
| 2014/0373699 | A1 | 12/2014 | Drushal | 84/411 R |
| 2015/0075354 | A1 * | 3/2015 | Sallee et al. | 84/402 |
| 2015/0114204 | A1 | 4/2015 | Lochen | 84/402 |
| 2015/0114206 | A1 | 4/2015 | Krol | 84/417 |

FOREIGN PATENT DOCUMENTS

| | | |
|---|---|---|
| DE | 202015001744 | 4/2015 |
| JP | 3184744 U | 7/2013 |
| TW | 491238 U | 12/2014 |

OTHER PUBLICATIONS

Office Action from U.S. Appl. No. 14/351,793, dated Aug. 10, 2015.
Office Action from U.S. Appl. No. 14/523,511. dated Oct. 5, 2015.
SlapDrum's SlapBoxx Cajon Reviewed!, Drum Magazine, Sep. 20, 2010.

* cited by examiner

CHANNELED SHAKER

This application claims the benefit of priority to U.S. Provisional Patent Application Ser. No. 61/339,461, filed Mar. 4, 2010 and is a continuation of U.S. Pat. No. 8,779,263 issued Jul. 15, 2014.

BACKGROUND

Percussion musical instruments capable of creating a rhythm are known in the art. Shakers are one type of percussion instrument capable of generating a rhythmic pattern of sound by moving the shaker back and forth. Prior art shakers typically comprise a striker material freely disposed in an enclosed shaker body. Although a percussionist may obtain different sound patterns while operating such a shaker, it is difficult for the percussionist to produce different sounds and different rhythms using a single shaker. In addition, it is difficult for the percussionist to control the rhythmic patterns and tempos.

SUMMARY OF THE INVENTION

The present invention relates to a musical shaker capable of producing different percussion sounds and different rhythms in a single shaker and having improved control in producing rhythmic sounds. In a preferred embodiment, the shaker comprises a wooden body having a first striking surface and a second striking surface; at least one channel disposed inside the body; the channel extending between the first striking surface and the second striking surface; at least one striker disposed inside the channel; the channel isolating the striker from the interior of the shaker body; the striker freely movable within the channel such that the striker is capable of striking the first striking surface and the second striking surface when the shaker is moved.

In a preferred embodiment, the shaker comprises a core assembly separately insertable into the shaker body, the core assembly comprising a frame and a plurality of channels. In a further preferred embodiment, the core assembly comprises a top layer, a bottom layer, and a plurality of channel layers; the channel layers comprising a plurality of channels; the core assembly separately insertable into the shaker body. In a further preferred embodiment, the shaker comprises a core assembly separately insertable into the shaker body with channels formed directly into the core assembly.

DESCRIPTION OF THE DRAWINGS

Like reference symbols in the various drawings indicate like elements.

DETAILED DESCRIPTION

The present invention generally relates to a musical shaker that produces a variety of different sounds and different rhythms and that provides improved control in producing rhythmic sounds. Further explanation and variations of the present invention are described below with reference to FIGS. 1-10.

Figure 1:
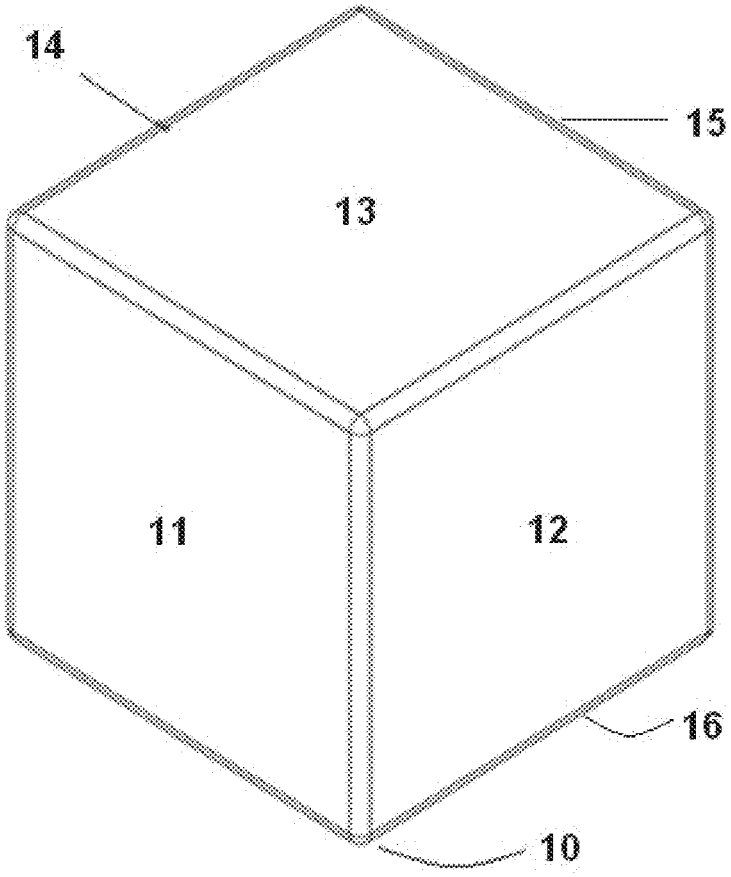
FIG. 1 is an illustrative external view of a cubical shaker according to one embodiment of the present invention.

FIG. 1 is an illustrative external view of a cubical percussion shaker 10 according to one embodiment of the present invention. The shaker 10 is a substantially enclosed body that comprises a plurality of striking surfaces 11-16. The striking surfaces 11-16 also form the outer walls of the shaker 10. The striking surfaces 11-16 are preferably made of wood, but any of a variety of materials can be used, such as, for example, plastic, metal, or a combination of different materials. Different materials may be used to produce different sounds. Also, the inner faces of striking surfaces 11-16 (not shown) may be lined or coated with a different material than the material that forms the outer wall. Although a cubical shaker is shown, the external shape of the shaker may vary. For example, the shaker may be triangular, rectangular, pentagonal, hexagonal, octagonal, cylindrical, or spherical. Further, the striking surfaces may be concave or convex depending on the desired appearance and/or the desired sound.

Figure 2:
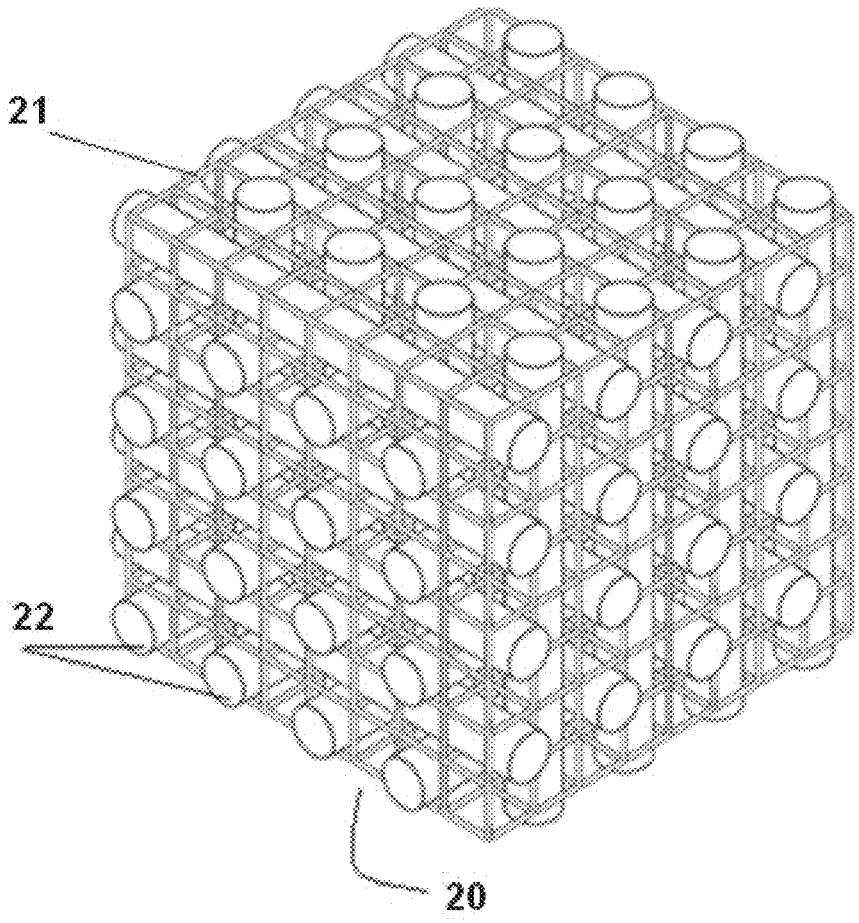
FIG. 2 is an illustrative view of a core assembly according to one embodiment of the present invention.

FIG. 2 is an illustrative view of a shaker core assembly 20 according to one embodiment of the present invention. The core assembly 20 comprises a frame 21 and a plurality of channels 22, 23, and 24 supported by the frame. In a preferred embodiment, the frame 21 is made from a wire mesh and the channels are made from plastic tubes. The frame 21 holds the channels 22 and 23 in a horizontal alignment and channel 24 a vertical alignment.

Figure 3:
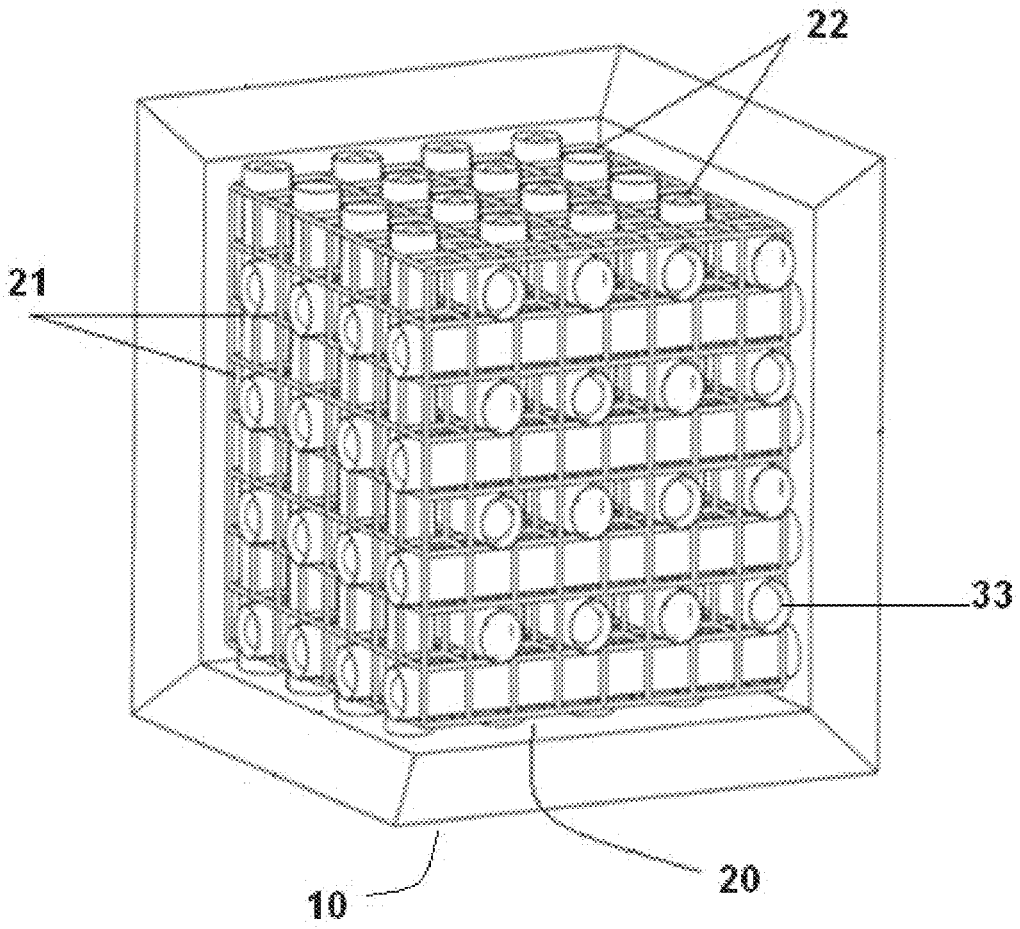
FIG. 3 is an illustrative cut-away view of a shaker according to one embodiment of the present invention.

FIG. 3 is an illustrative cut-away view of a shaker according to one embodiment of the present invention. The core assembly 20 fits in the shaker 10 such that the channels 22, 23, and 24 extend between opposing striking surfaces in either the horizontal or the vertical direction. A person of ordinary skill in the art will understand that the channels may be oriented in a variety of directions according to the shape of the shaker body. The channels may also be made from any variety of materials. Additionally, the channels may take various shapes, including but not limited to circular (shown in FIG. 3), elliptical, square, rectangular, honey comb, or triangular.

Figure 4:
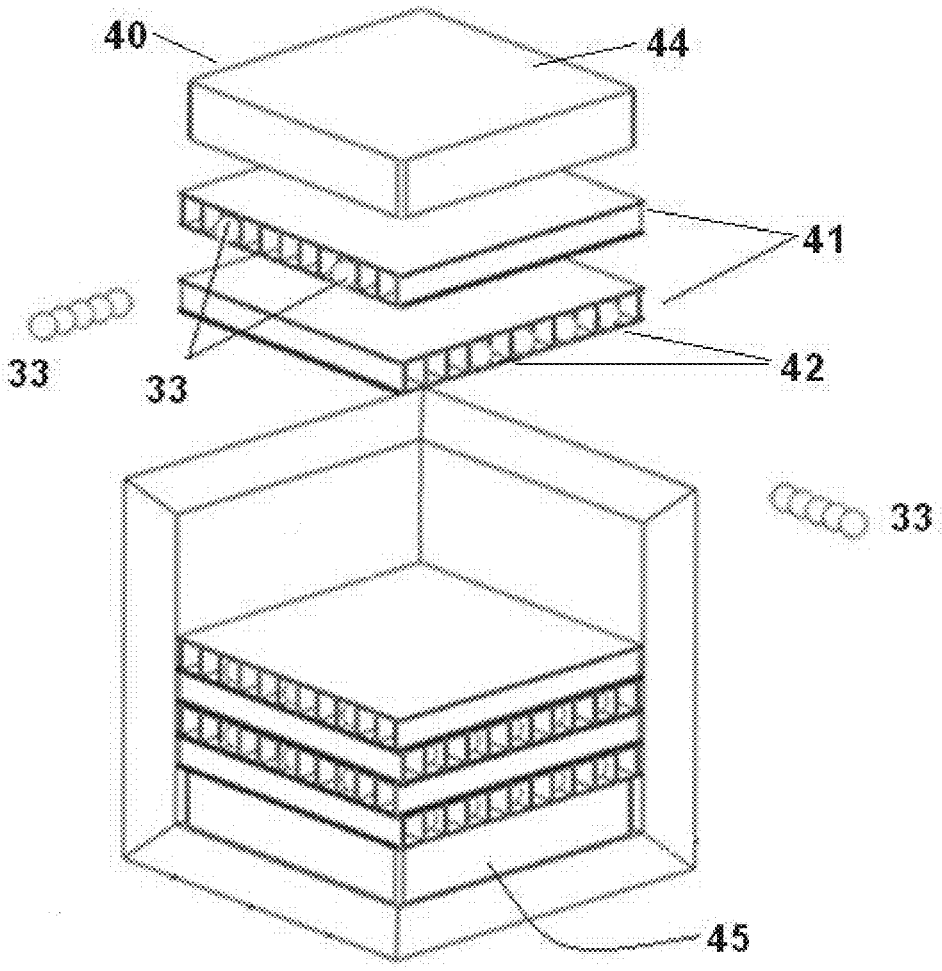
FIG. 4 is an illustrative cut-away view of a core assembly according to one embodiment of the present invention.

In a preferred embodiment, a striker material 32, 33, and 34 (percussive medium) is disposed in one of more of the channels 22, 23, and 24 respectively. Although FIG. 3 only shows one striker in each channel, each channel may comprise a plurality of strikers, as shown in FIG. 4. The striker material is preferably freely movable within the channel such that it may strike the striking surfaces at either end of the channel when the shaker body 10 is moved. The channels isolate the strikers from the internal cavity of the shaker body 10 and from the strikers disposed in other channels. By limiting the range of motion of the striker material, the channels allow for greater control of the percussive medium. In addition, by having separate strikers in separate channels, the shaker is capable of producing different and independent sounds. For example, when a user moves the shaker 10 such the striker material moves back and forth between striking surfaces 11 and 13, the shaker produces a first sound. If the user moves the shaker 10 such that the striker material moves back and forth between striking surfaces 12 and 14, the shaker produces a second sound. The sounds may differ, for example, in volume or in tone.

If the user rotates the shaker in a circular, semi-circular, elliptical, or other non-linear motion, the user may cause the shaker to produce different rhythms, such as syncopated rhythms, different notes, such as sixteenth or thirty-second notes, or different tempos. For example, if the user rotates shaker 10 in a clockwise motion, the centrifugal force about the axis of rotation will cause the strikers 32 and 33 to move back and forth within the channels 22 and 23 such that striking surfaces 11, 12, 13 and 14 are struck sequentially.

Figure 5:
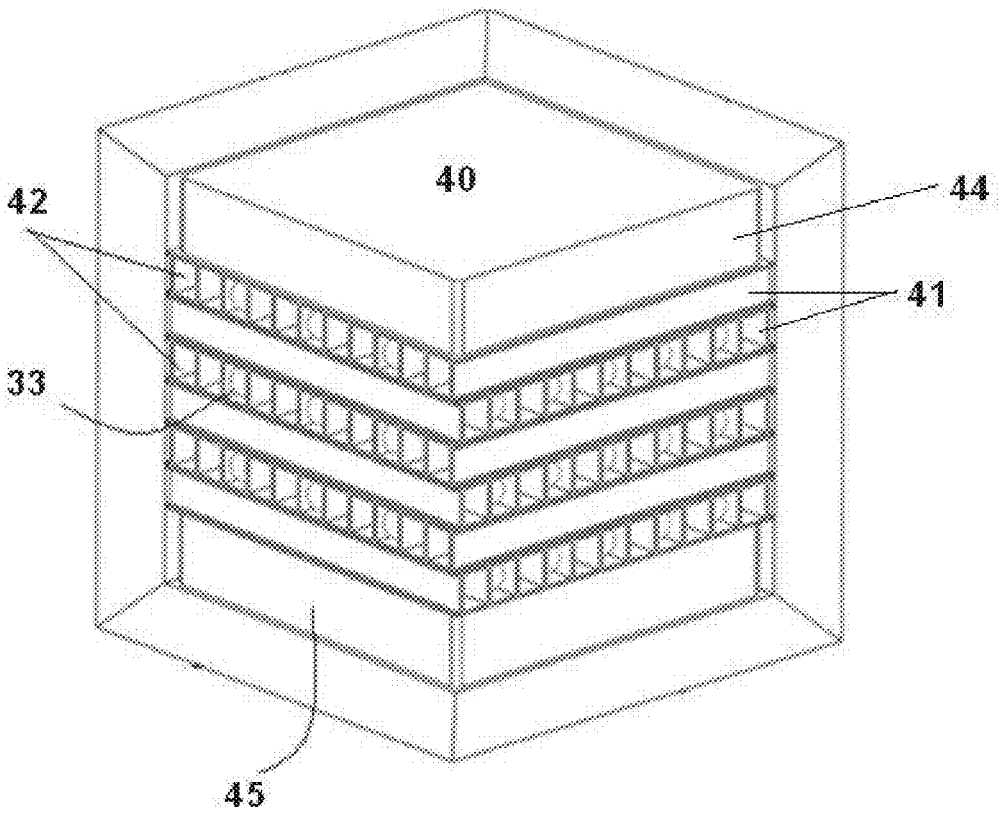
FIG. 5 is an illustrative cut-away view of a shaker according to one embodiment of the present invention.

FIG. 4 is an illustrative cut-away view of a core assembly according to another embodiment of the present invention. The core assembly 40 comprises a top layer 45 and a bottom layer 46 made from a foam material. The core assembly 40 further comprises a plurality of corrugated channel layers 41 and 43 disposed in between the top layer 45 and the bottom layer 46. The channel layers may be formed by injection molding or another suitable manufacturing process. Each channel layer 41 and 43 preferably comprises a plurality of channels 42 and 44 respectively. The channel layers 41 and 43 fit in the body of the shaker 10 such that the channels extend between striking surfaces on opposite sides of the shaker. The channel layers 41 and 43 are preferably oriented within the shaker in an alternating manner such that the channels of one layer run perpendicular to the channels of the layer immediately above and/or immediately below it. The core assembly 40 fits within the shaker body as shown in FIG. 5.

FIG. 4 further depicts a striker material 32 and 34 in the form of round metal beads. The striker, however, may be of any variety of shapes, sizes, and materials. In the embodiment shown, the striker is a sphere. The striker may, however, be a cylinder, a cube, a rectangular prism, or irregular shapes like chips or shad. In addition, the striker may be formed from a variety of different materials. For example, in addition to metal, the striker may be made from plastic or wood. The striker may be a single piece or multiple pieces that fit within the channels. Further, the striker may be disposed on rods disposed within the channels that extend the length of the channels. By varying the size, shape, quantities, and composition of the striker material, shakers with different sounds may be produced.

Figure 6:
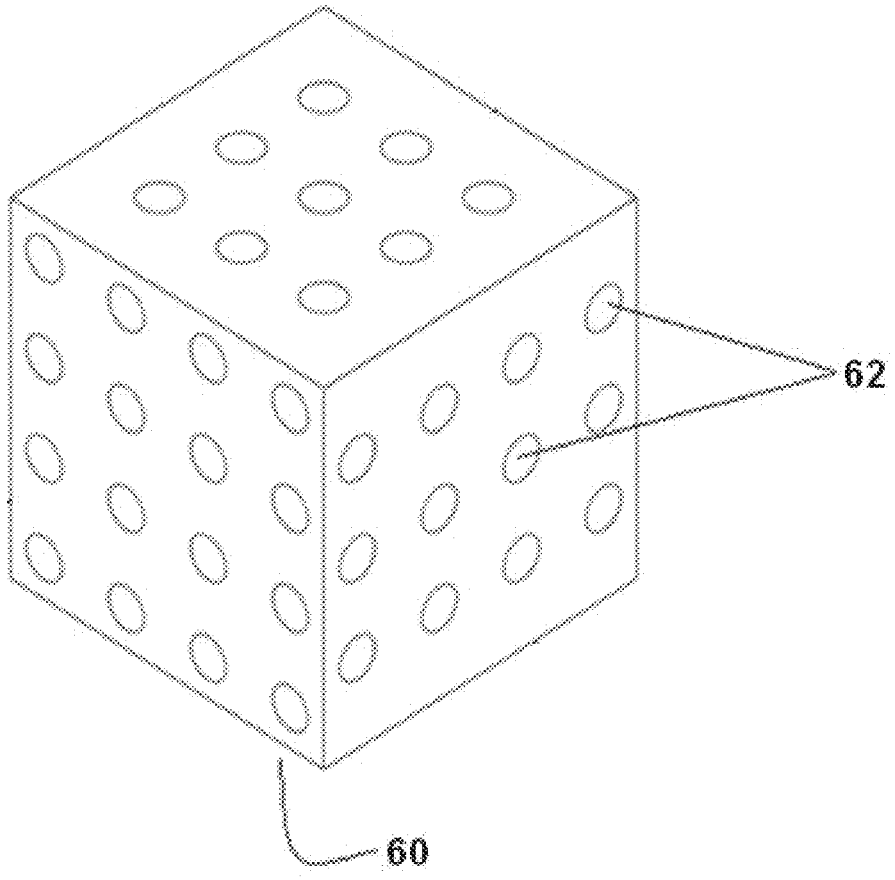
FIG. 6 is an illustrative view of a core assembly according to one embodiment of the present invention.
Figure 6A:
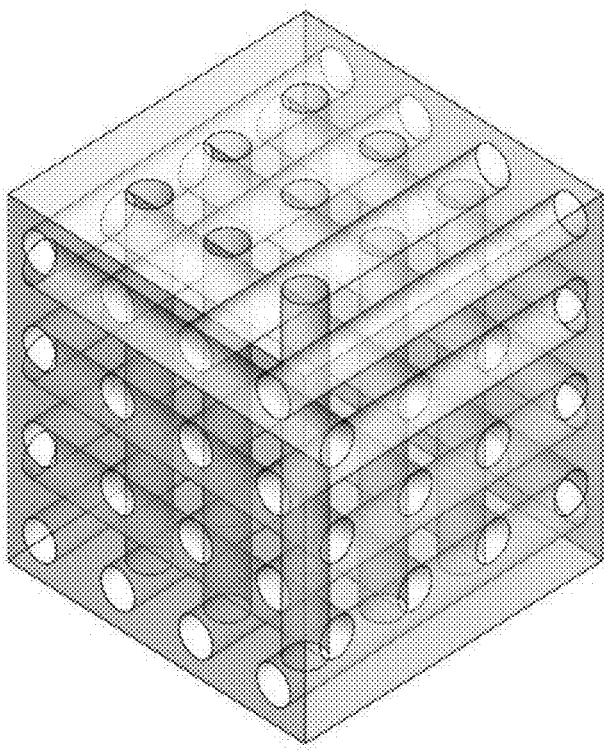
FIG. 6A is a further illustrative view of the core assembly of FIG. 6.
Figure 7:
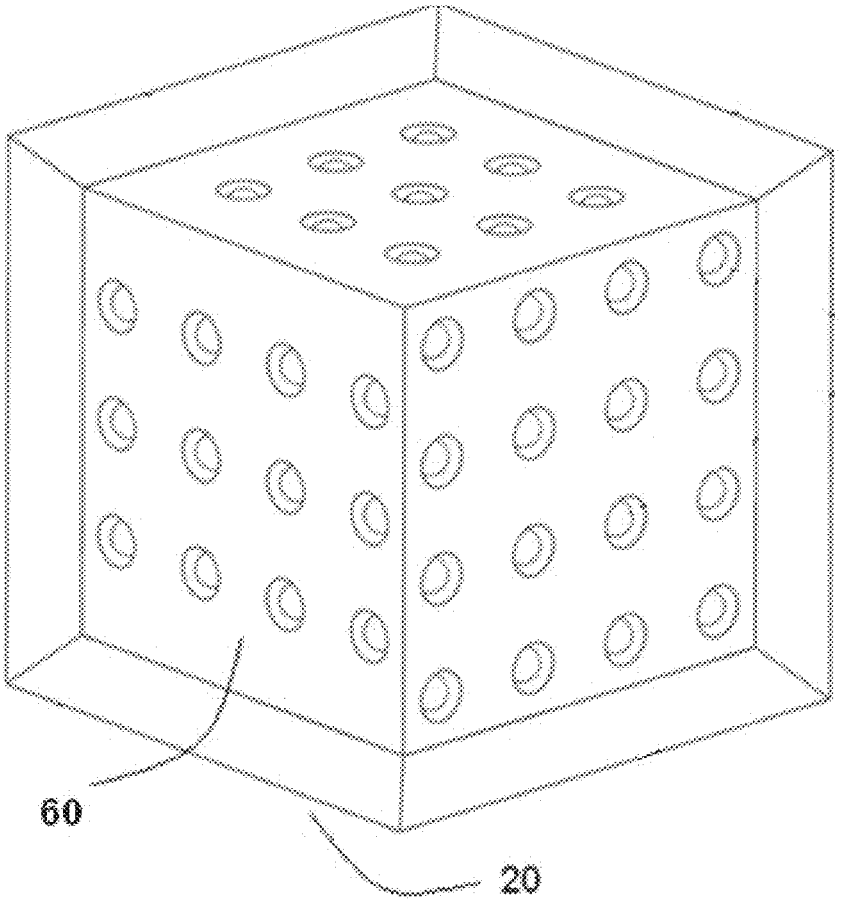
FIG. 7 is an illustrative cut-away view of a shaker according to one embodiment of the present invention.

FIG. 6 is an illustrative view of a core assembly according to another embodiment of the present invention. In this embodiment, the core assembly 60 is a single body. The channels 62, 63, and 64 are formed into the core assembly 60, by drilling or another suitable process. These internal channels 62-64 are shown in FIG. 6A. The core assembly 60 is preferably made from an acrylic material but other materials may be used. The core assembly 60 may be inserted separately into the shaker body 10 as shown in FIG. 7.

Figure 8:
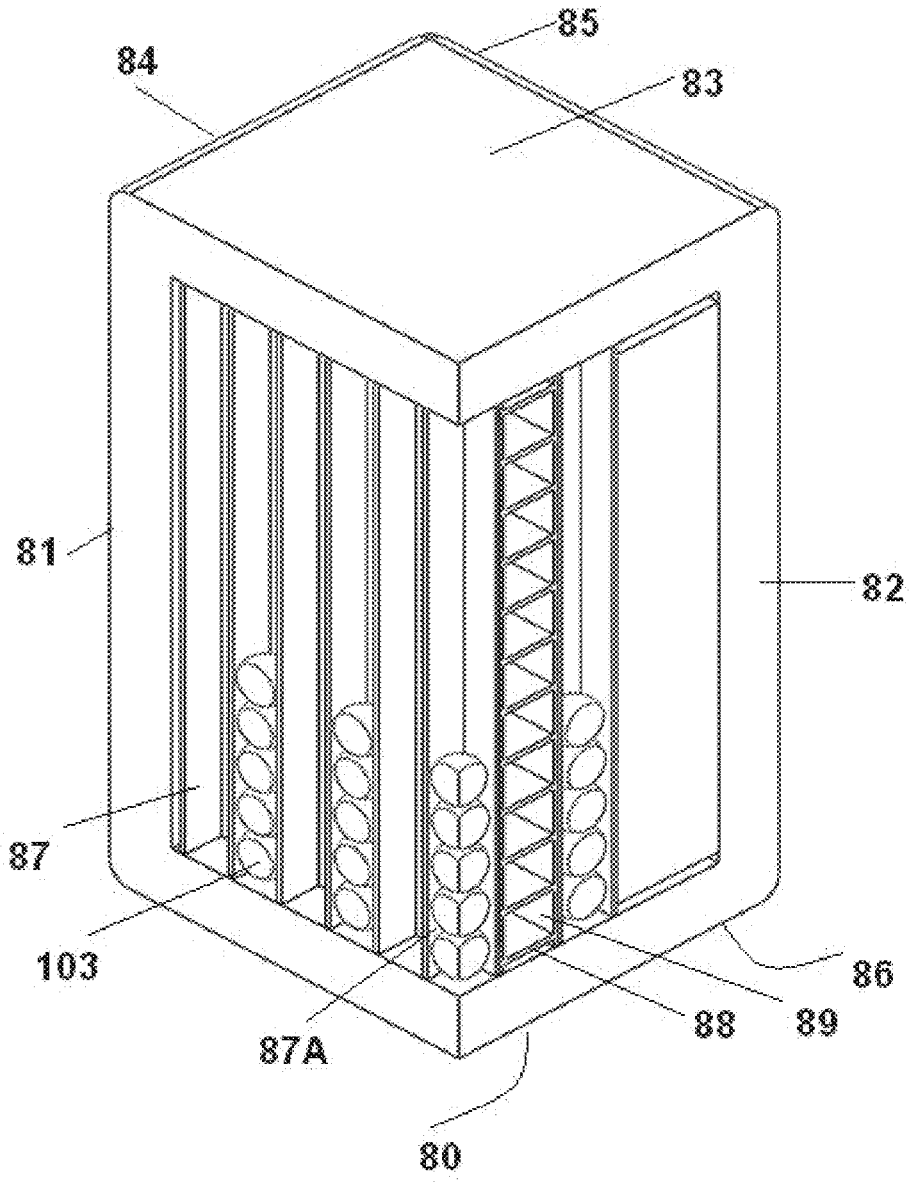
FIG. 8 is an illustrative cut-away view of a rectangular shaker according to one embodiment of the present invention.

FIG. 8 is an illustrative cut-away view of a rectangular shaker according to one embodiment of the present invention. Like the cubical shaker, the rectangular shaker 80 has six striking surfaces 81-86. As shown in FIG. 8, striking surfaces 81 and 82 have been cut away to show a plurality of vertical and horizontal channels. The vertical channels 87, 87A line the inner perimeter of the shaker 80. The vertical channels 87 along the sides of the shaker preferably consist of three sides. The fourth side is formed by the wall of the shaker 80 (not shown). Each of the vertical channels 87A on the corner of the shaker preferably consists of two sides. The third and fourth sides are formed by the walls of the shaker 80 that meet at the corner. One or more horizontal channels layers 88 are preferably interspersed between the vertical channels 87 along the sides of the shaker 80. Each horizontal channel layer 88 preferably comprises a plurality of channels 89.

In a preferred embodiment, a striker material 103 is disposed in one of more of the vertical channels 87, 87*a* and one or more of the horizontal channels 89. Each channel may comprise one or more strikers. The striker material 103 is preferably freely movable within the channel such that it may strike the striking surfaces at either end of the channel when the shaker body 80 is moved. In one embodiment, the strikers disposed in vertical channels 87 have a flat surface on the side opposing the shaker wall. The striker material disposed in the vertical channels 87A have a flat surface on the sides opposing the two shaker walls that meet at the corner. The channels isolate the striker 103 from the internal cavity of the shaker body 80 and from the strikers disposed in other channels. By limiting the range of motion of the striker material, the channels allow for greater control of the percussive medium. In addition, by having separate strikers in separate channels, the shaker is capable of producing different and independent sounds.

Figure 9:
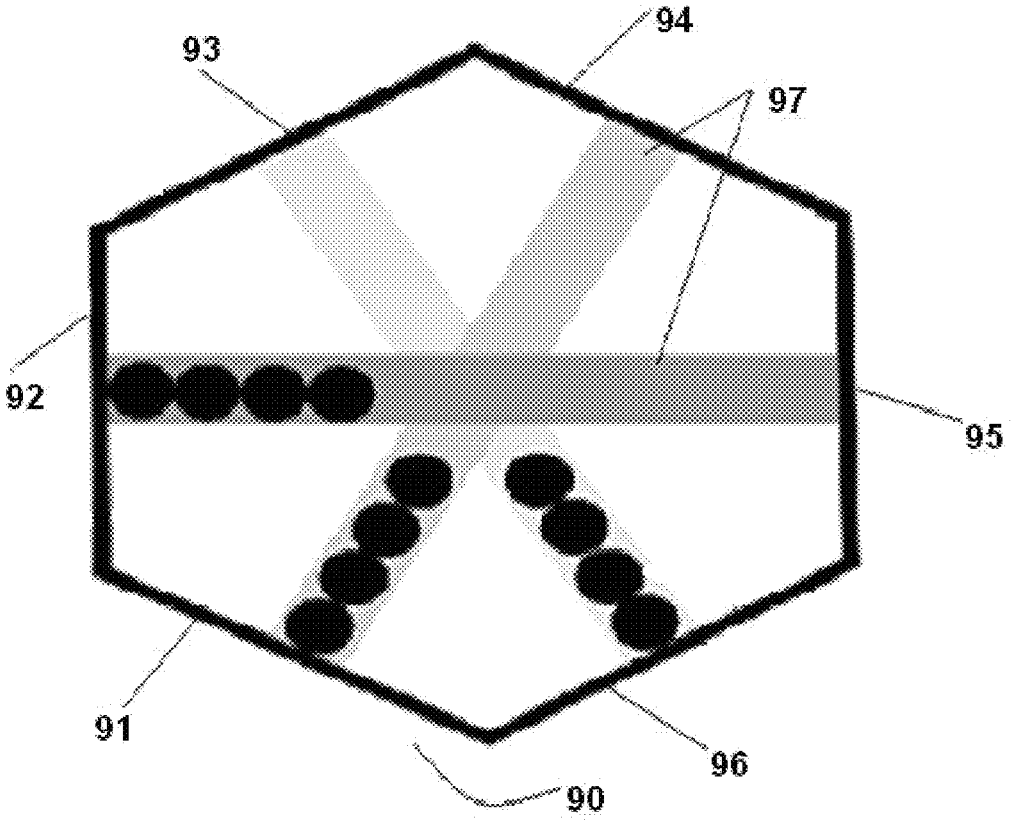
FIG. 9 is an illustrative cross-sectional view of a shaker according to one embodiment of the present invention.

FIG. 9 is an illustrative cross-sectional view of a hexagonal shaker according to another embodiment of the present invention. The hexagonal shaker has eight possible striking surfaces: striking surfaces 91-96, shown in FIG. 9, and a top striking surface and a bottom striking surface, not shown. Each channel extends between a pair of striking surfaces. As such, the shaker 90 can produce at least four independent sounds.

Figure 10:
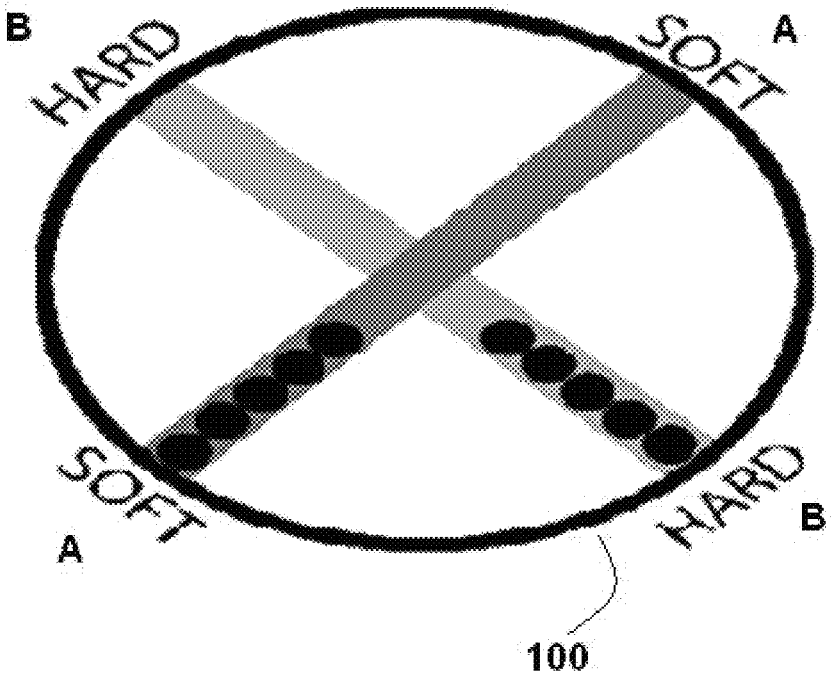
FIG. 10 is an illustrative cross-sectional view of a shaker according to one embodiment of the present invention.

Similarly, FIG. 10 is an illustrative cross-sectional view of a cylindrical shaker according another embodiment of the present invention. FIG. 10 shows that the shaker 100 may comprise striking surfaces of different strength. For example, one channel may be oriented such that a first striker may move between two soft striking surfaces (A-A) and another channel may be oriented such that a second striker may move between two hard striking surfaces (B-B). As such, the shaker 100 is capable of producing at least two different sounds. For example, when a user moves the shaker between A-A, the shaker may produce a low volume sound. Conversely, when a user moves the shaker between B-B, the shaker may produce a high volume sound.

In a further embodiment of the present invention, one or more of the striking surfaces may be made from a material that has variable tension. The tension may be produced by a tension mechanism such as a lug, a rope, or a strap. Additionally, the shaker may be equipped with a mechanism that can alter the tension of the striking surfaces while playing the instrument. For example, the shaker may be equipped with a handle that may be squeezed to vary the tension of the striking surface while shaking the shaker. The handle may be placed around the body of the shaker or joined to the shaker.

In another embodiment of the present invention, the shaker may preferably be equipped with an electronic trigger inside the shaker. The trigger transmits a signal to a sound module that produces a variety of synthesized sounds. The signal may be hard-wired or transmitted wirelessly. One of the advantageous features of using triggers with the present invention is that the channels allow for greater control of the striking material. Thus, multiple triggers may used to produce a variety of synthesized sounds, either synonymously or independently. A switching mechanism may be used to control which triggers are activated. The shaker may preferably be used to produce any of the multiple sounds available in electronic sound production. For example, a cubical shaker with channels in three directions (height, width, depth) may be used to produce a standard (I, IV, V) chord progression used in popular music.

In a further embodiment, the shaker may be equipped with a lighting mechanism such as LED (Light Emitting Diodes) lights, laser diodes, or any other suitable lighting device. The lights are preferably triggered when a striker strikes a striking surface. The channeled shaker may control which lights are triggered by the direction of the channels being used.

In a further embodiment of the present invention, the shaker may comprise channels placed at variable angles within the shaker, such as diagonal angles rather than perpendicular angles with the striking surfaces. This positioning provides the percussionist with another method of playing the shaker to produce sound. For example, the shaker may be tilted either quickly or slowly to produce a rippled sound effect as different strikers make contact with the striking surfaces in sequential time intervals.

In another embodiment of the present invention, the striker material may be movably attached to a rod disposed within the channel. For example, the striker may comprise a hole such that the rod may be inserted in the hole and the striker may slide back and forth between a first striking surface and a second striking surface along the rod.

One advantageous feature of the present invention is that the shaker can be moved in multiple directions, such as circular, semi-circular, elliptical, or other non-linear motions, to produce different sounds and rhythms. For example, one of the sounds available by moving a cubical shaker in a circular motion is a double time sound produced by the strikers hitting the four perpendicular sides sequentially.

Another advantageous feature of the present invention is that the channeled shaker may produce a sound by being rotated about its central axis. The channeled shaker may be rotated by hand or with a separately designed rotator similar to a hopper. The sound produced by rotating the shaker can be varied depending on striker material used and/or striker surface material used. The ability to produce sounds by rotating the shaker allows for larger diameter shakers than would normally be held in the hand.

A number of embodiments of the invention have been described. Nevertheless, it will be understood that various modifications may be made without departing from the spirit and scope of the invention. Accordingly, other embodiments are contemplated within the scope of the following claims.

We claim:

1. A percussive shaker instrument comprising:

an enclosed body, the enclosed body comprising a plurality of striking surfaces;

a plurality of channels, the channels disposed inside the enclosed body, the channels further extending between a first striking surface and a second striking surface;

a plurality of strikers, the strikers disposed inside the channels;

the strikers freely movable within the channels such that the strikers are capable of striking the first striking surface and the second striking surface when the instrument is moved;

wherein said strikers are capable of producing a variety of sounds upon striking the first striking surface and the second striking surface.

2. The instrument of claim 1 wherein the enclosed body is substantially cubical.

3. The instrument of claim 1 wherein the enclosed body is made of wood.

4. The instrument of claim 1 further comprising a core assembly, the core assembly insertable in the enclosed body.

5. The instrument of claim 4 wherein the core assembly comprises a frame, the frame supporting the channels.

6. The instrument of claim 4 wherein the core assembly comprises a top layer, a bottom layer, and one or more channel layers.

7. The instrument of claim 4 wherein the channels are formed into the core assembly.

8. The instrument of claim 7 wherein the core assembly is acrylic.

9. The instrument of claim 1 further comprising:

at least a second channel, the second channel disposed inside the chamber, the second channel further extending between a third striking surface and a fourth striking surface;

at least a second striker, the second striker disposed inside the second channel;

the second striker freely movable within the second channel such that striker is capable of striking the third striking surface and the fourth striking surface when the instrument is moved.

* * * * *